United States Patent [19]

Farraj

[11] Patent Number: 4,936,576

[45] Date of Patent: Jun. 26, 1990

[54] AMUSEMENT DEVICE

[76] Inventor: Hefetz Farraj, 8 Harakevet Street, Lod, Israel

[21] Appl. No.: 182,930

[22] Filed: Apr. 18, 1988

[51] Int. Cl.[5] ..... A63F 7/00

[52] U.S. Cl. ..... 273/1 L

[58] Field of Search ..... 273/1 L

[56] References Cited

U.S. PATENT DOCUMENTS

| | | | |
|---|---|---|---|
| 485,314 | 11/1892 | Woolf | 273/1 LX |
| 700,887 | 5/1902 | Barron | 273/113 |
| 1,061,173 | 5/1913 | Greene | 273/113 |
| 1,617,382 | 2/1927 | Farquhar | 273/113 |
| 2,746,757 | 5/1956 | Frost | 273/1 L |

FOREIGN PATENT DOCUMENTS

| | | | |
|---|---|---|---|
| 2103940 | 3/1983 | United Kingdom | 273/1 L |
| 2127306 | 4/1984 | United Kingdom | 273/1 L |

*Primary Examiner*—Paul E. Shapiro

*Attorney, Agent, or Firm*—Helfgott & Karas

[57] ABSTRACT

A hand held amusement device has a liquid filled container having a number of different length open mouth elongated hollow compartments extending from one wall. A number of liquid buoyant cubical bodies are present in the container. Each body has different indicia on each face, and all the bodies have the same indicia. A user manipulates the container to attempt to get a different body in each compartment with the same face indica on each body uppermost.

6 Claims, 2 Drawing Sheets

AMUSEMENT DEVICE

The present invention relates to amusement devices, and more particularly to devices comprising movable bodies which must be skillfully manoevered into pre-determined locations, and in a pre-determined order. Still more specifically, the invention concerns buoyant bodies immersed in a liquid contained within a sealed receptacle, comprising one or more compartments, with an opening through which the bodies have to be passed by manipulating the receptacle into various positions.

Figure 1:
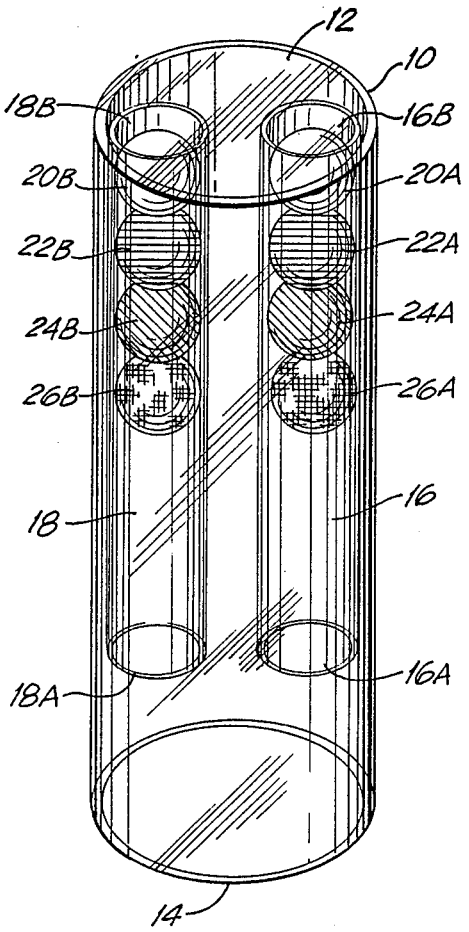
Figure 2:
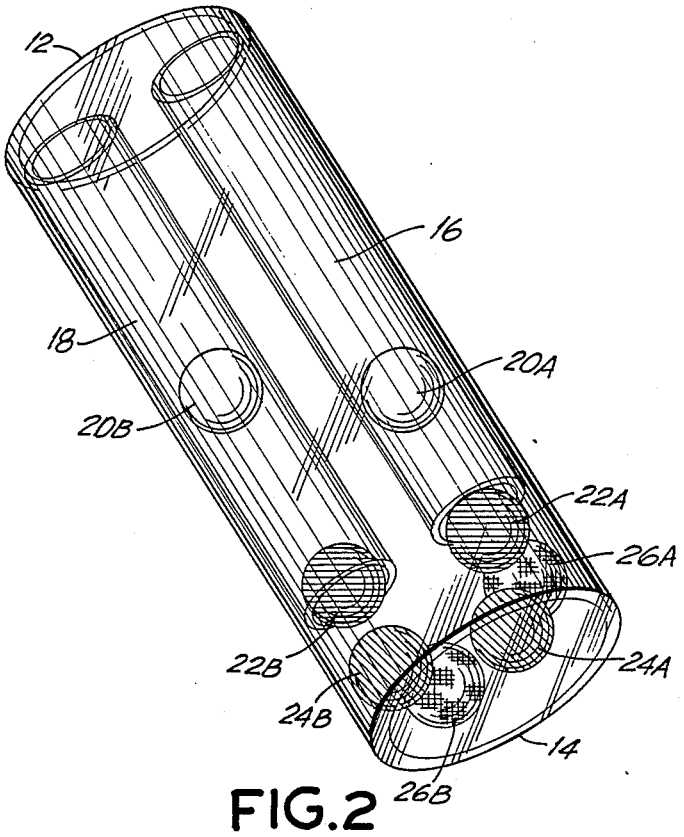
Figure 3:
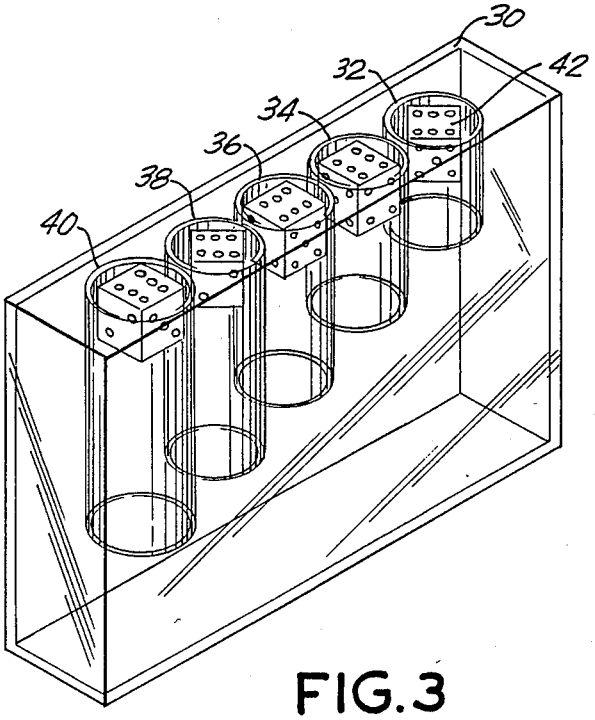

The invention, its variety of possibilities and applications will be further exemplified in the following description of two preferred embodiments thereof, given with reference to the accompanying drawings, wherein FIG. 1 is a three-dimensional view of the device according to a first embodiment of the invention, in its arranged, or "winning" position;

FIG. 2 shows the device of FIG. 1 in one of its manoevering or intermediate positions; and FIG. 3 is a three-dimensional view of a second embodiment of the invention.

In FIG. 1 there is shown a cylindrical receptacle or housing marked 10, made of a transparent material which is sealed at both ends 12 and 14 and completely filled with liquid such as water.

In the example shown there are provided a pair of tubular compartments 16 and 18 open at one of their ends 16A and 18A while their opposite sides 16B and 18B are attached—as by gluing or cementing—to the inner side of the receptacle closure 12. The length of the tubes is somewhat less the height of receptacle 10.

Immersed in the liquid contained in the receptacle 10 are a plurality—in this case, eight—buoyant bodies, composing together four matching pairs, namely 20A and 20B, 22A and 22B, 24A and 24B, and 26A and 26B. The bodies are shown to be spherical, but any other shapes may also be applicable. Further, the pairs of balls may be marked by numbers, be of different colours, or bear any other kind of marks for the visual identification thereof by the player. The material of the bodies may be of any suitable kind provided its specific gravity is slightly less than that of the liquid in which they are immersed.

As shown in FIG. 2, receptacle 10 is in an inverted, upside-down position. Due to the buoyancy thereof, the bodies will float—and accumulate at the upper portion of the receptacle 10, next to the closure 14.

In using the device, the player has to manipulate the receptable 10 in order to insert—one by one—a selected body into one of the compartments 16, or 18.

Once one of the bodies, say 20A, is inserted, it must be kept within its respective compartment while the player tries to insert the matching body, say 20B, into the other compartment. This calls for skill and patience because once the receptacle is brought into an upside-down position, the first inserted body may escape its compartment before its matching body is introduced into the other compartment; moreover, it is to be avoided that an unmatching body slip into the compartment.

Experience with this model of the amusement device proves that it takes some ten minutes or more to manipulate all four pairs of bodies into their respective compartments and thus play is completed.

The second embodiment of the invention, exemplified in FIG. 3, follows the same principles of construction and use. The device comprises a receptacle 30—however of a prismatic shape—again filled with liquid, and provided with four compartments 32, 34, 36, 38, and 40, being in this case of gradually increasing lengths, as shown.

The buoyant bodies are constituted by numbered playing cubes 42 which are conventional except that their material is of a specific gravity slightly less than that of the liquid.

The mode of playing is by causing each one of the cubes 42 to become inserted into its respective compartment, however, not at random, but with one of the sides—say, the one marked with six dots—facing upwards in the final, winning position.

It will be noted that the variant lengths of the compartment make it more difficult to manipulate the bodies 42 by repeatedly inverting the position of the receptacle 30.

Completing this mission takes about half an hour, or more, depending on the skill of the player.

It will be readily understood in the light of the foregoing description, that a wide range of varieties may be used following the basic constructional concept of the invention. Thus, the number of compartments and the number of respective buoyant playing bodies, as well as their relative shapes may differ from one model to the other, depending on the expected skill of the players for whom the device is designed. Various grades of difficulty may be achieved, allowing designs of the device for very small children on the one hand, and for adults on the other. The device is compact, handy, and may be played in any environment, such as at home, while travelling, etc.

Those skilled in the art will readily appreciate that various other modifications and changes may be applied to the invention without departing from its scope as defined in and by the appended claims.

What is claimed is:

1. An amusement device comprising a sealed, liquid-filled receptacle of a transducent material, a plurality of elongated hollow compartments disposed within the receptacle, each compartment extending from one of end walls of the receptacle and terminating by an open mouth located between said one end wall and an opposite end wall, a plurality of buoyant cubical bodies immersed in the liquid which fills the receptacle, said receptacle having two opposing side walls, said compartments being positioned within said receptacle side by side to each other between said opposing side walls and being of gradually increasing lengths from one side wall towards another side wall, said buoyant cubical bodies having faces provided with similar indicia for all cubical bodies but different indicia on different faces of each cubical body, said bodies being adapted to become inserted into each of said compartments through the mouth thereof while the receptacle is held so that the compartment extends in a generally vertical upside-down position so that the faces of said bodies carrying the same indicia can face upwards.

2. The device as claimed in claim 1, wherein the bodies are made of a material having a specific gravity slightly less than that of the liquid.

3. The device as claimed in claim 1, wherein said compartments are tubular.

4. The device as claimed in claim 1, wherein each side of said bodies is marked differently from another side thereof.

5. The device as claimed in claim 4, wherein score numbers are marked on said cubical bodies.

6. The device as claimed in claim 1, wherein the receptacle is prismatic.

* * * * *